United States Patent [19]

Badoni

[11] Patent Number: 4,896,447

[45] Date of Patent: Jan. 30, 1990

[54] SAFETY MAINTENANCE IMPLEMENT FOR FIREARMS

[76] Inventor: Paul A. Badoni, 5724 Gainsborough Place, Oak Forest, Ill. 60452

[21] Appl. No.: 292,360

[22] Filed: Dec. 30, 1988

[51] Int. Cl.[4] ..... F41C 31/00

[52] U.S. Cl. ..... 42/95; 42/96

[58] Field of Search ..... 42/90, 95, 96, 70.11

[56] References Cited

U.S. PATENT DOCUMENTS

| | | | |
|---|---|---|---|
| 2,403,452 | 7/1946 | Novak | 42/90 |
| 2,877,484 | 3/1959 | Taylor et al. | 42/90 |
| 2,997,802 | 8/1961 | Robbins | 42/70.11 |
| 3,089,272 | 5/1963 | McKinlay | 42/70.11 |
| 3,378,943 | 4/1968 | Valburg | 42/70.11 |
| 3,605,311 | 9/1971 | Hermann | 42/70.11 |
| 3,634,963 | 1/1972 | Hermann | 42/70.11 |
| 3,765,115 | 10/1973 | Johansson et al. | 42/70.11 |
| 4,528,765 | 7/1985 | Johnson | 42/70.11 |
| 4,603,498 | 8/1986 | Johnson | 42/70.11 |

FOREIGN PATENT DOCUMENTS

| | | | |
|---|---|---|---|
| 7502 | 5/1889 | United Kingdom | 42/90 |
| 12435 | 10/1985 | United Kingdom | 42/90 |

*Primary Examiner*—Deborah L. Kyle
*Assistant Examiner*—Michael J. Carone
*Attorney, Agent, or Firm*—Evan D. Roberts

[57] ABSTRACT

A trough-shaped safety maintenance implement to be inserted, positioned and locked into the receiver cavity of a firearm.

11 Claims, 1 Drawing Sheet

SAFETY MAINTENANCE IMPLEMENT FOR FIREARMS

BACKGROUND OF THE INVENTION

This invention relates to a safety maintenance implement for semi-automatic firearms having a receiver cavity. When manipulating the firearm for cleaning and inspection, it is necessary to have access to the barrel breech to allow the insertion and use of cleaning implements, and to prevent dirt and debris, from the barrel breech, from entering into the receiver cavity and general mechanisms of the firearm. Also, during cleaning and inspection of the firearm, it is highly desirable to visually and physically assure that the firearm cannot fire.

Existing known types of supplemental devices for use with firearms provide a safety plug which will prevent the firearm from firing; or means for inspecting the firearm; or means for cleaning the firearm.

SUMMARY OF THE INVENTION

This invention relates to a safety maintenance implement for semi-automatic firearms which, by a single implement, provides an implement that: is positionable in the receiver of the firearm to seal the firearm against entry of cleaning dirt and debris; and will assure that the firearm will not fire.

Accordingly, it is a general primary object of the safety maintenance implement of this invention to provide a firearm implement which, when inserted in the receiver of the firearm, will preclude the bolt from engaging the breech to prevent inadvertent firing of the weapon.

A further object of the safety maintenance implement of the invention is to provide a visible indication of the blocking of the bolt as a safety factor.

An additional object of the safety maintenance implement of this invention is to provide a trough-shaped body for sealing the receiver of the firearm to prevent cleaning dirt and debris from the barrel breech entering the receiver.

Another object of the safety maintenance implement of this invention is to provide an implement which, when in place, will allow communication with the barrel breech to, in turn, allow cleaning of the breech and the barrel while the implement is in place.

A still further object of the safety maintenance implement of this invention is to provide an implement which will be locked into place by the bias action of the bolt to guarantee its retention in position for cleaning and safety.

Figure 1:
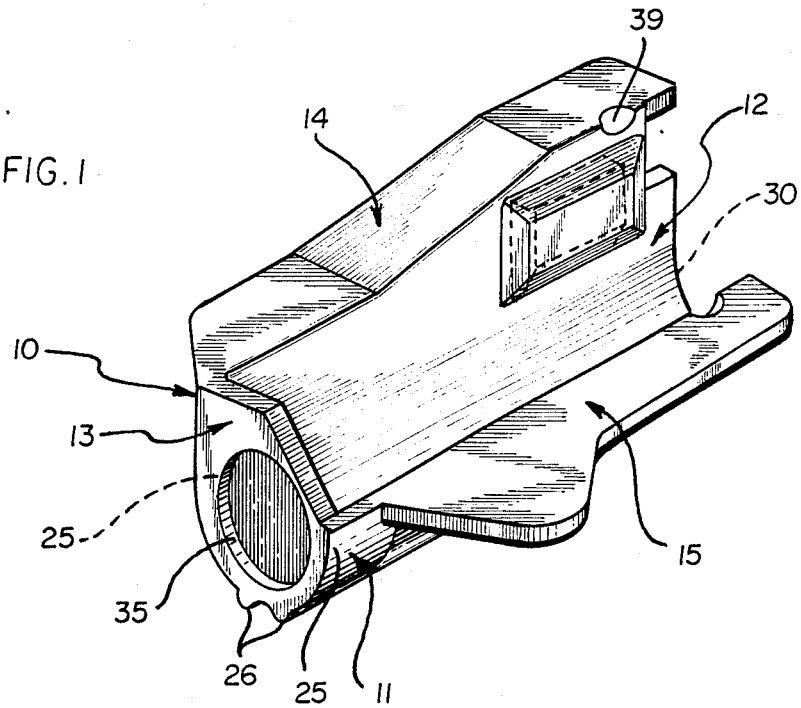
Figure 2:
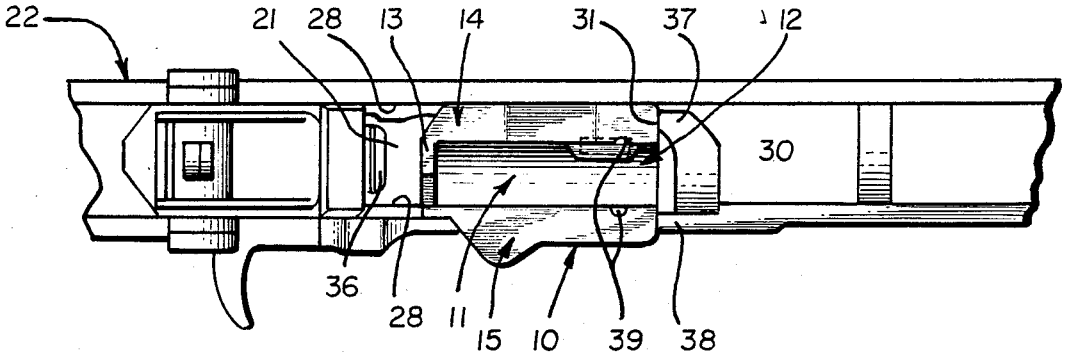
Figure 3:
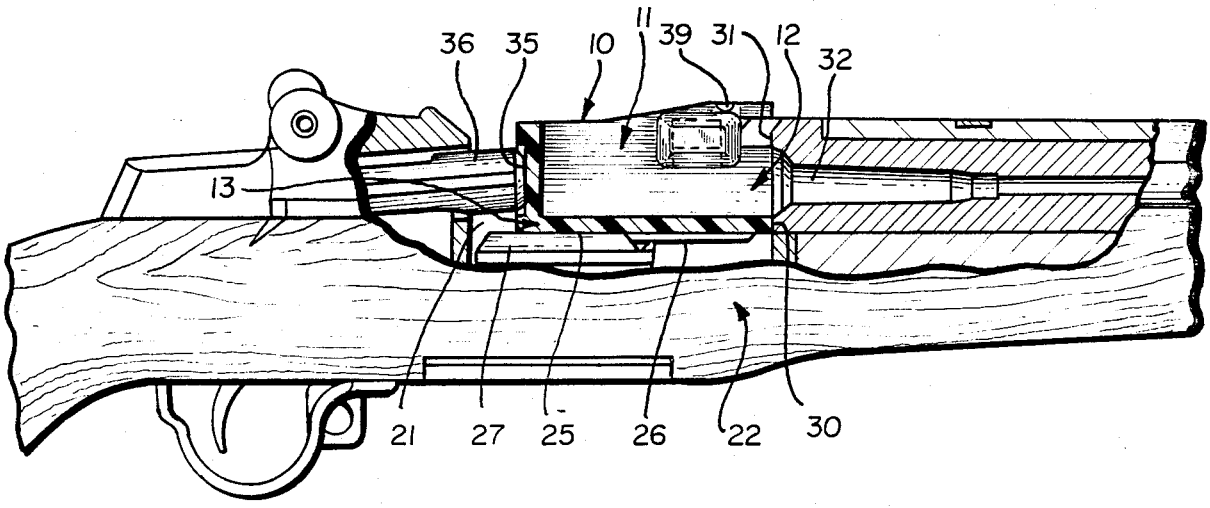

Another object of the safety maintenance implement of this invention is to provide an implement which is readily positionable in the receiver to guarantee that the breech is sealed while the trough thereof is in general alignment with the barrel and barrel breech of the firearm. Other advantages and novel aspects of this invention will become apparent from the following detailed description, in conjunction with the accompanying drawings wherein:

FIG. 1 is a perspective view of the safety maintenance implement of this invention showing the general configuration of the implement;

FIG. 2 is a top view of a firearm having the bolt retracted and the safety maintenance implement of this invention positioned into the receiver of the rifle before the implement is locked in place; and FIG. 3 is a partially cutaway side elevation view of a semi-automatic firearm showing the safety maintenance implement of this invention firmly locked in place in the receiver of the firearm to be manipulated for cleaning and inspection.

The safety maintenance implement of this invention is generally illustrated (FIGS. 1–3) by the numeral 10, preferably made of semirigid plastic. Safety maintenance implement 10 includes generally, a trough-shaped body 11 with front and rear portions 12 and 13 respectively, and left and right handling and positioning flanges 14 and 15.

Body 11 has a trough 12 extending longitudinally and opening upwardly from a receiver cartridge chamber 21 of a firearm 22 when implement 10 is inserted in receiver cavity 21 of the firearm 22. Body 11 has an external surface 25 which is generally complementary to the inside surfaces of receiver 21. In the embodiment illustrated herein, implement 10 is configured to be complemental to the internal surfaces of a receiver 21 of United States service rifles such as the M-1 Gerand, the M-14 or M-lA. In this regard, implement body 11 has rails 26 on the bottom adapted to engage cartridge rails 27 (FIG. 3) of receiver 21 and side portions 25 adapted to complementally engage sides 28 of receiver.

Forward portion of implement body 11 is provided with surface 30 adapted to fit flush against barrel breech surface 31 and around the sides and bottom of barrel breech opening 32, of barrel breech 33, and around barrel breech opening 31 (FIG. 2). Implement 10 will, thereby, seal front surface 30 thereof against surface 31 when urged into engagement with surface 31 to prevent dirt and debris from passing from the barrel breech 33 through barrel breech opening 31 and into the receiver 21 during cleaning or other maintenance or manipulation of firearm 22.

Rear portion 13 of implement body 11 is provided with a bolt recess 35 adapted to receive a forwardly biased firearm bolt 36 into recess 35. Forwardly biased bolt 36 will thereby longitudinally force implement 10 against breech surface 31 to seal breech 33 and retain and position implement 10 laterally within recess 35 to lock implement 10 in place (FIG. 3).

Longitudinal laterally extending left and right flanges 14 and 15 are provided on implement body 11 to seat respectively downwardly on left and right top surfaces 37 and 38 of firearm receiver 21 as a further means of positioning implement 10 within receiver 21. Also, flanges 37 and 38 (FIG. 2) extend laterally to be a visible indication that implement 10 is in place in firearm receiver 21, providing physical and visual safety and the preclusion of receiver contamination.

Flanges 14 and 15, at the area of trough 12, are provided with lateral clearance reliefs 39 to allow cleaning equipment, or the like, to be rotated or oscillated from side to side, to a greater extent, in trough 12.

In operation, the safety maintenance implement of this invention is inserted in the firearm 22 by first grasping right flange 15, then retracting bolt 36 and placing implement 10 in cartridge receiver 21 (FIG. 2) with flanges 14 and 15 down against firearm receiver surfaces 37 and 38. Bolt 36 is thereafter released to allow the forward bias thereof to move bolt 36 into implement recess 35 (FIG. 3). Implement 10 is thereby inserted and installed in firearm 22, and located and locked into position with surface 30 thereof in complemental flush engagement with barrel breech surface 31.

When implement 10 is thus installed in receiver 21, barrel breech cleaning equipment can be positioned in trough 12, and the cleaning portion of the equipment (not shown) can be inserted to the right (FIG. 3) reciprocally into barrel breech.

Also, the cleaning apparatus can be rotated in barrel breech and any handle or lateral portion of the cleaning apparatus used for this reciprocating or rotating motion is free to move in implement trough 12 and the scope of rotational motion can be enhanced by lateral clearance reliefs 39 in trough 20 and flanges 14 and 15. When any cleaning apparatus is removed from barrel breech 33 or reciprocally longitudinally moved therein, any dirt and debris removed from barrel breech 33 will naturally be deposited into implement trough 12, and implement trough 12 will preclude that dirt and debris from entering cartridge receiver 21.

What is claimed is:

1. A safety maintenance implement for semi-automatic action firearms having an elongated receiver cavity in which a firearm bolt is reciprocally supported and normally biased forwardly toward an opening of a barrel breech of the firearm comprising a trough-shaped body adapted to engage and seal the interior of the receiver cavity against dirt and debris with said body trough opening laterally outwardly of the receiver substantially along the entire length of said body.

2. A safety maintenance implement for semi-automatic firearms as defined in claim 1 wherein flanges are positioned longitudinally along said body and extending laterally therefrom to engage the firearm on the top of the receiver for positioning said body at a predetermined depth in the receiver.

3. A safety maintenance implement for semi-automatic firearms as defined in claim 1 wherein said body has a forward portion having an opening adapted to communicate with the opening of the barrel breech when said body is inserted in the receiver for providing longitudinal lateral access between said trough and the barrel breech to facilitate insertion of barrel breech cleaning implements from the body into the barrel.

4. A safety maintenance implement for semi-automatic firearms as defined in claim 3 wherein flanges are positioned longitudinally along said body and extending laterally therefrom to engage the firearm on the top of the receiver for positioning said body at a predetermined depth in the receiver.

5. A safety maintenance implement for semi-automatic firearms as defined in claim 1 wherein said body forward portion is larger than the opening of the barrel breech and is adapted to engage the firearm at the opening of the barrel breech and said body has a rearward portion adapted to complementally receive biased engagement from the bolt when said body is positioned in the receiver for holding the implement against the barrel breech while maintaining the seal of the receiver and limiting the bolt from normal bias engagement with the barrel breech.

6. A safety maintenance implement for semi-automatic firearms as defined in claim 5 wherein flanges are positioned longitudinally along said body and extending laterally therefrom to engage the firearm on the top of the receiver for positioning said body at a predetermined depth in the receiver.

7. A safety maintenance implement for semi-automatic firearms as defined in claim 5 wherein said forward portion is longitudinally notched to receive some portion of the firearm to laterally position and lock said forward portion against lateral movement in the receiver, and said rearward portion is recessed to biasly complementally receive a portion of the bolt thereinto for laterally positioning and locking said rearward portion in the receiver.

8. A safety maintenance implement for semi-automatic firearms as defined in claim 5 wherein said forward portion has an opening adapted to communicate with the opening of the barrel breech when said body is inserted in the receiver for providing longitudinal access between said trough and the barrel breech to facilitate insertion of barrel breech cleaning implements from the body into the barrel.

9. A safety maintenance implement for semi-automatic firearms as defined in claim 8 wherein said forward portion is longitudinally notched to receive some portion of the firearm to laterally position and lock said forward portion against lateral movement in the receiver, and said rearward portion is recessed to biasly complementally receive a portion of the bolt thereinto for laterally positioning and locking said rearward portion in the receiver.

10. A safety maintenance implement for semi-automatic firearms as defined in claim 8 wherein flanges are positioned longitudinally along said body and extending laterally therefrom to engage the firearm on the top of the receiver for positioning said body at a predetermined depth in the receiver.

11. A safety maintenance implement for semi-automatic firearms as defined in claim 10 wherein said forward portion is longitudinally notched to receive some portion of the firearm to laterally position and lock said forward portion against lateral movement in the receiver, and said rearward portion is recessed to biasly complementally receive a portion of the bolt thereinto for laterally positioning and locking said rearward portion in the receiver.

* * * * *